United States Patent [19]

Gates

[11] 4,068,818

[45] * Jan. 17, 1978

[54] CLAMPING LOCK FOR TIE ROD ENDS

[75] Inventor: H. Gordon Gates, Denver, Colo.

[73] Assignee: Gates & Sons, Inc., Denver, Colo.

[ * ] Notice: The portion of the term of this patent subsequent to Oct. 5, 1993, has been disclaimed.

[21] Appl. No.: 714,032

[22] Filed: Aug. 13, 1976

Related U.S. Application Data

[63] Continuation-in-part of Ser. No. 494,967, Aug. 5, 1974, Pat. No. 3,984,079.

[51] Int. Cl.[2] ..... E04G 17/06

[52] U.S. Cl. ..... 249/42; 249/46; 249/190; 249/216; 249/219 R

[58] Field of Search ..... 269/126–128, 269/237–238; 24/263 DL, 263 LL, 263 LS, 248 L, 248 B, 248 CR, 248 PC, 248 DP, 248 PP, 248 LL; 249/40–46, 190–191, 213, 214, 216, 217, 219 R, 219 W

[56] References Cited

U.S. PATENT DOCUMENTS

| | | | |
|---|---|---|---|
| 1,509,022 | 9/1924 | Noble | 24/249 PP |
| 1,755,572 | 4/1930 | Church | 24/263 DL |
| 2,190,748 | 2/1940 | Williams | 249/42 |
| 2,217,072 | 10/1940 | Nixon | 24/263 DL |
| 2,297,899 | 10/1942 | Krueger | 249/196 |
| 2,324,184 | 7/1943 | Wyman | 24/263 DL |
| 3,529,800 | 9/1970 | Gates | 249/213 |
| 3,633,867 | 1/1972 | Eriksson | 249/42 |
| 3,693,931 | 9/1972 | Holt | 249/46 |
| 3,927,858 | 12/1975 | Underhill | 249/213 |
| 3,984,079 | 10/1976 | Gates | 249/219 R |

*Primary Examiner*—Robert D. Baldwin
*Assistant Examiner*—John McQuade
*Attorney, Agent, or Firm*—Sheridan, Ross, Fields & McIntosh

[57] ABSTRACT

There is provided an improved clamping lock for tie rod ends in form structures for settable casting compositions, e.g., concrete casting forms, which lock is characterized by means for attaching it to the form structure, and a pair of jaws shaped for mating coaction with the outer end of a tie rod end whereby relative axial movement of the lock with respect to the tie rod end is prevented and the form structure is correspondingly held against movement toward or away from an opposite form structure.

10 Claims, 25 Drawing Figures

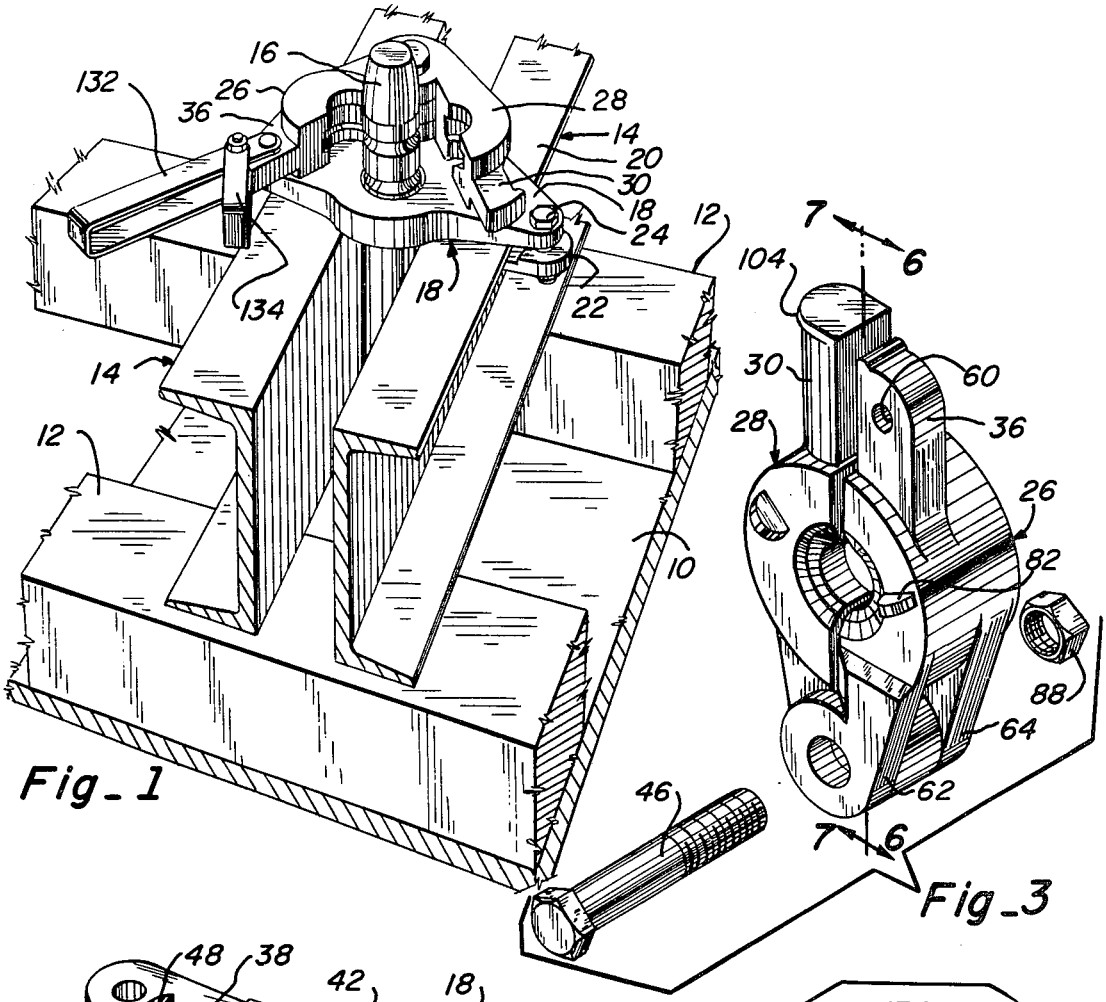
Fig_1
Fig_3
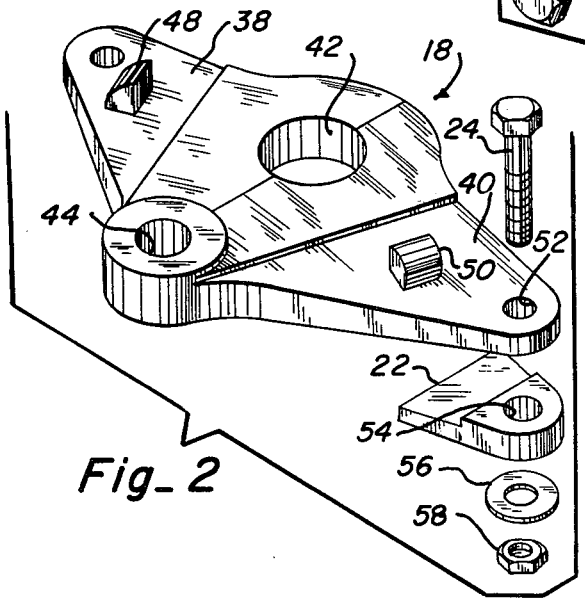
Fig_2
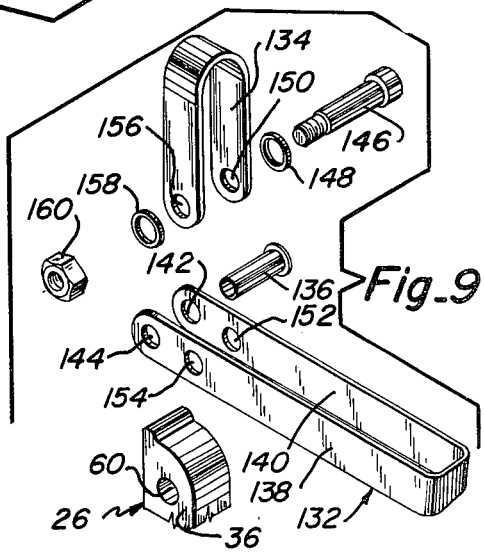
Fig_9

CLAMPING LOCK FOR TIE ROD ENDS

RELATED DOCUMENT

This application is a continuation in part of my application Ser. No. 494,967 filed Aug. 5, 1974 entitled CLAMPING LOCK FOR TIE ROD ENDS, now U.S. Pat. No. 3,984,079, issued Oct. 5, 1976.

BACKGROUND OF THE INVENTION AND PRIOR ART

Heavy forms for vertical wall concrete casting in the past have generally been built with a combination of wood and steel or in some cases, where large amounts of repeat usage can be expected, an all steel form. In either case, the forms are most generally backed up vertically or in some cases horizontally with two heavier steel channels or wales, spaced on between 2 to 5 foot centers. As the channels are placed on the back of the form, they are spaced about 1 ½ to 2 inches apart to permit a heavy steel bolt or bolt-type of form tie to pass through the one form, through the zone that will become the concrete wall, and into and through the opposite form. In first constructing a heavy duty form, a plywood or steel facing is prepared that will be the confronting surface against the concrete. If plywood is used, in most cases such plywood is ¾ of an inch thick, it is generally backed up or reinforced with fir 4 × 4's or 4 × 6's on 12 inch centers. If a steel form face is used, in most cases 3/16 inch thick, it is most generally backed up with steel angles about 3 inches by 3 inches or light 3 or 4 inch steel channels, also on about 12 inch centers. The heavy steel stiff back channels or wales are then secured in place as before mentioned on two, three, four or five foot centers, depending on the tie spacing that is desired. The rate at which the concrete is to be placed and the height of the wall also helps to govern the tie spacing. As previously stated, the channels are spaced about 1 ½ to 2 inches apart to permit a heavy steel bolt or bolt-type of form tie to pass between the forms from one side through the concrete zone and then through the opposite form on the other side.

In the past the bolt or tie has been designed with a standard thread or a coarse Acme thread, and secured in place with a large thick plate washer resting against the back of the two spaced steel channels or wales on the backside of each of the wall forms. Then, a nut is run down over the threads on each end of the tie to achieve the proper spacing for the wall thickness desired. With this type of form construction, there has never been a satisfactory provision for properly spacing and spreading the forms internally. Most of the ties used in the past in heavy concrete forming have been of the bolt design with a removable nut on each end. Because of the inability to strut the form panels apart, certain types of wall forming can create a problem in proper spacing. One good example is that of a battered wall where one of the forms is standing vertically, but the other form is tilted. Consider, for example, a wall that at the bottom is 30 inches in width and at the top of a 20 foot wall is only 12 inches in width. With this type of wall and a heavy form that will weigh often in excess of 10 pounds per square foot, there is a definite problem of the tilted form tending to fall against the face of the vertical wall form. Ties with a spreader or for a spacer have been used to hold both forms in the proper position. However, the spreaders or spacers may need to be sacrificed or, if removed, require plugging. Still a further problem encountered in this type of tie is that the installer can tighten the nut on one tie tighter than on another, and then further down the wall, be looser than another, causing the wall to be wavy and for some of the ties to be overloaded and some ties not carrying any or very little load. This can also be dangerous and contribute to or cause a wall failure which in the industry is known as a "break out".

The present invention solves the problems indicated above and provides a tie and a form lock that can be used with any type of conventional gang form presently being marketed or built by the contractor, or for a form design utilizing the basic concept of a facing material or either wood or steel against the concrete. This in turn is backed up with either wood or steel preferably running horizontally. Then vertically, this assembly is backed with heavy steel channels on two to four or five foot centers running from the bottom to the top of the form and acting as a strong back and the main member to which the locks of the present invention are attached to receive the pressure of the wet concrete. These channels or wales are usually applied in pairs and spaced about two inches apart. It is to these vertical spaced apart channel members or wales that the locks of the present invention are applied on a prescribed spacing not to exceed about 5 feet by 5 feet.

BRIEF STATEMENT OF THE INVENTION

Briefly stated the present invention is in a clamping lock for a tie rod end in a settable casting composition form structure which comprises in combination a base plate having a tie rod end receiving bore extending therethrough and means for fastening the base plate to the casting form structure, particularly the wales. A pair of jaws are pivotally anchored on the base plate and selectively movable between an open position and a closed position about the tie rod end. Means are provided which coact between jaws when closed and the tie rod end for preventing axial movement of the jaws with respect to the tie rod end. Means are also provided for releasably locking the jaws in the closed position.

In a more specific embodiment of the present invention, the jaw confronting surface of the base plate uniformly decreases in thickness bilaterally from a line corresponding to the parting line of the jaws when closed to exert a wedging effect on the jaws in closing and a quick release effect in opening. In still more specific embodiments, the respective surfaces of the jaws in confronting relation with the base plate so uniformly sloped may also oppositely uniformly increase in thickness in a direction away from the parting line of the jaws when closed. Generally this slope is less than 10° and preferably about 5°.

The present invention is also in a concrete form system including sheathing, studs, wales and tie rods wherein the improvement includes in combination a tie rod end having one end internally threaded for threaded for threaded engagement with a tie rod and an outer end extending beyond the wales and a tie rod end clamping lock as above described.

BRIEF DESCRIPTION OF THE DRAWING

The invention will be better understood by having reference to the annexed drawings wherein:

FIG. 1 is a perspective view showing a portion of a concrete casting form including sheathing, 4 × 4 studs, and 2 × 4 channel beams as wales with a tie rod end projecting therebetween and a clamping lock of the present invention opened and about to be applied to the tie rod end.

FIG. 2 is a perspective top view of a base plate and showing in exploded relation therewith clamping means for holding the base plate to a wale.

FIG. 3 is a perspective view of a pair of jaws in closed relation and showing in exploded relation therewith a pin for securing the jaws to the base plate such as that shown in FIG. 2.

FIG. 9 is an exploded view closed a releasable locking means for holding the jaws in cloed position.

DETAILED DESCRIPTION OF THE DRAWINGS

Figure 4:
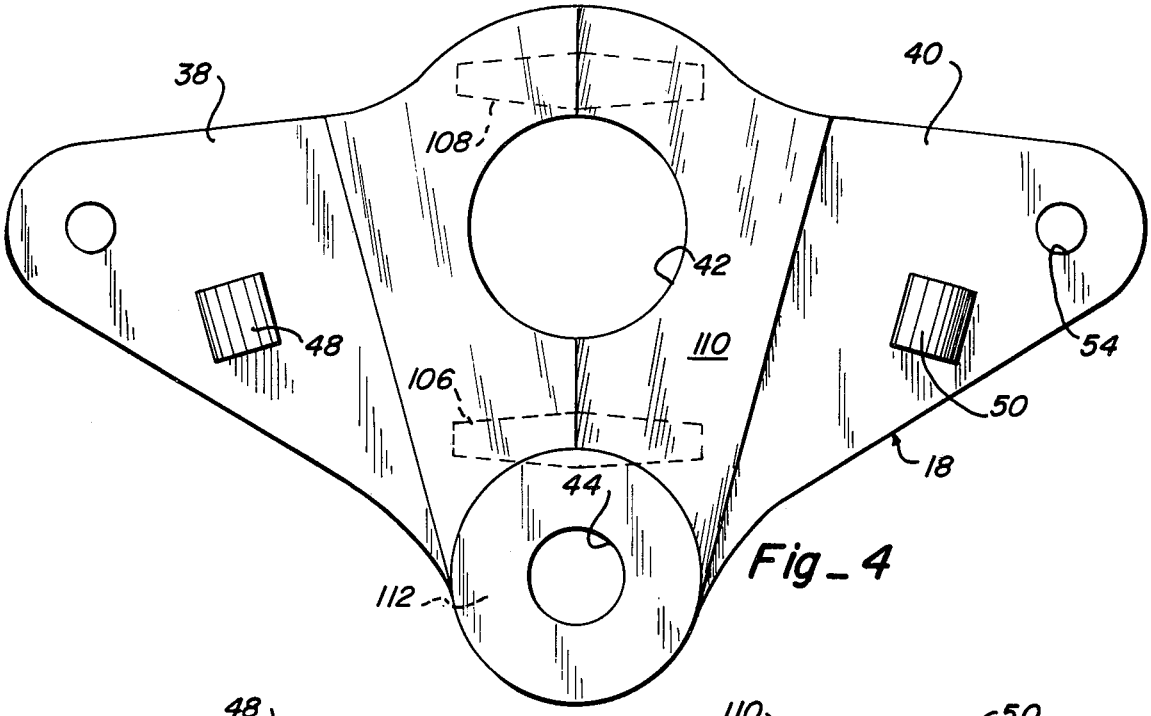
FIG. 4 is a top plan view of the base plate shown in FIG. 2.

Referring now more particularly to FIG. 1, there is here shown in perspective a portion of a casting composition form structure including a face material of either wood or steel such as sheathing 10 the opposite face of which not shown in FIG. 1 is intended to be in contact with the wet concrete for forming the latter during hardening. Behind the sheathing 10 and generally on 12-inch centers there are provided studs 12 which are conveniently formed of 4 × 4 pine wood. Behind the studs 12 there are conveniently provided steel channels or wales 14 in back-to-back relation and spaced apart from 1 to 2 inches to permit a tie rod end 16 to extend therebetween. A base plate 18 is conveniently clamped to the outstanding flange 20 of the channel beam 14 by any suitable means such as a clamp member 22 secured thereto by a bolt 24 extending through the base plate 18 and holding the clamping member 22 tightly against the inner surface of the flange 20 by means of a nut not shown in FIG. 1. The opposite end of the base plate 18 is also similarly clamped to the opposite channel member 14 by a clamping member bolt and nut which are not visible in FIG. 1. The jaws 26 and 28 are shown in their open position prior to clamping about the tie rod end 16. The jaw member 28 is provided with a projecting lug 30 over which a strap 134 may be looped when the jaws are closed, and tight locking effected by means of the lever handle 132 pivotally attached to a projecting lug 36 extending from jaw 26.

FIG. 1 shows only a single tie rod end and lock therefor in a fragmentary portion of a concrete casting form structure for illustrative purposes only. It will be understood that the tie rod end will project from either side of the completed form which includes a member opposite to that shown in FIG. 1 and through which the tie rod end on the opposite side projects in a like but opposite manner. An entire form includes a plurality of tie rods extending through both sides of forming structures in the manner indicated in FIG. 1 and on centers which may be anywhere from 3 to 5 feet. Thus, areas of 9 square feet up to 25 square feet may be accommodated by structures built up in the manner indicated. Casting form structures including sheathing, studs, wales and the tie rods are well known and the novel features of the present invention include a modification of the tie rod end and a clamping lock therefor. The balance of the forming structure exclusive of the tie rod ends as herein modified and the clamping locks is conventional.

In a preferred embodiment, the base plate as shown in perspective in FIG. 2 is of generally bat-like or delta shape and includes a left wing portion 38 for overlying one channel of a wale and a right wing portion 40 for overlying an opposite channel member of a wale. The base is provided with a bore 42 dimensioned to receive therethrough the outer extremity of a tie rod end such as tie rod end 16. The fit between the bore 42 and the tie rod end 16 is reasonably loose so that the base plate may be easily fitted thereover. The base plate is also bored as at 44 to accept a pin 46 (FIG. 3) for pivotally securing the jaws 26 and 28 thereto. In a preferred embodiment the wing portion 38 is provided with a left jaw stop 48 and the right wing portion 40 is provided with a right jaw stop 50. The purpose of the stops is simply to limit the extent of opening of the jaws and preserve compactness and ease in handling of the unit.

To secure base plate 18 to wales 14 (FIG. 1) there is conveniently provided and shown in exploded relation in FIG. 2 a clamping member 22 adapted to fit behind the flange 20 of a wale 14. To effect clamping a bolt 24 extends through a bore 52 in the wing 40 through a corresponding bore 54 in the clamping member 22, a washer 56 and a nut 58. The opposite left wing 38 is also provided with a similar clamping structure, but such a structure is not shown in FIG. 2.

Figure 6:
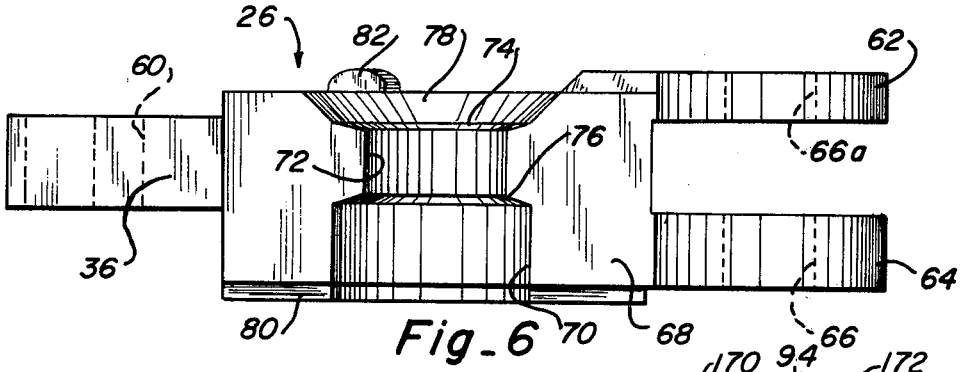
FIG. 6 is an orthogonal front view of one of the jaws shown in FIG. 3 as it appears in the plane indicated by the line 6—6.
Figure 7A:
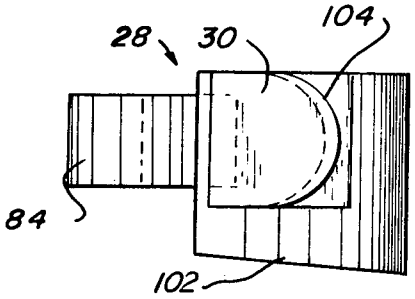
FIG. 7*a* is an orthogonal end view of the opposite jaw.
Figure 7:
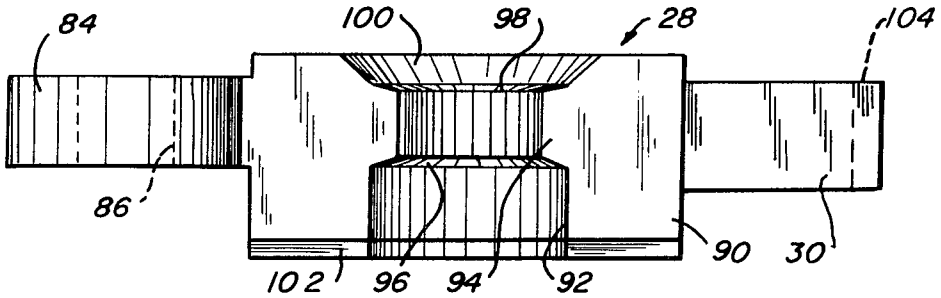
FIG. 7 is an orthogonal front view of the opposite jaw member shown in FIG. 3 as it appears in the plane indicated by the line 7—7 in FIG. 3.

FIGS. 3, 6 and 7 show in greater detail the clamping jaws of a preferred embodiment of the present invention. The jaw member 26 is also shown in FIG. 6, and the jaw member 28 is also shown in FIG. 7. Referring now to FIGS. 3 and 6, the right hand jaw member 26 as shown in FIG. 3 includes the projecting lug 36 having a bore 60 extending therethrough for purposes as will hereinafter be explained. The opposite end of the jaw 26 is provided with a pair of spaced pivot eyes 62 and 64 having a pivot bore 66, 66*a* extending therethrough.

The pivot eye portions 62 and 64 are integral with and extend from a central jaw portion 68 of generally semicircular configuration. The central jaw portion includes a pilot bore portion 70 dimensioned to receive the full diameter of the tie rod end. An inwardly projecting flange or neck 72 is provided having a radius of curvature less than the measured diameter of the tie rod end and adapted as hereinafter more particularly described to seat in a corresponding recess in the tie rod end. The inwardly projecting flange portion 72 is conveniently provided with tapered shoulder portions 74 and 76 for seating against corresponding shoulder portions in the tie rod end as later described. In a preferred embodiment, the shoulder portion 74 is a chamfer of about 20°. The shoulder portion 76 is chamfer of approximately 10°. The flange portion 72 is of generally semicircular configuration. A counter sink portion 78 is conveniently provided on the outer face of the jaw member 26 having an angle of approximately 45° with respect to the vertical.

Figure 6A:
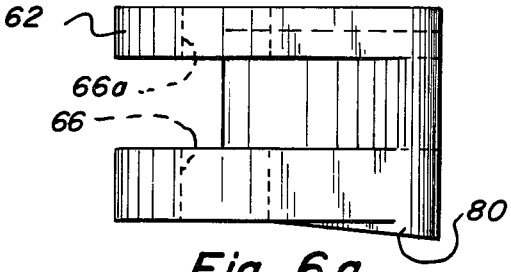
FIG. 6*a* is an orthogonal end view of one of the jaws shown in FIG. 3.

As best shown in FIGS. 6 and 6a, the lower face of the jaw 26 which is in confronting relation with the base plate 18 is, in a preferred embodiment, provided with a wedge surface 80 which is sloped at an angle of about 5° to the plane of the lower surface of the jaw 26. The purpose of the wedge 80 is to exert a tightening effect on closing the jaw, and a quick release effect when opening the jaw. The upper or outer surface of the jaw 26 may be provided with a hammer hit point 82 raised out of the plane of the upper surface. Although the internal surfaces of the pilot bore, the flange, the shoulder portions and the counter sink portions may be fully semicircular, the parting plane may be shaved back a few thousandths, for example, ten thousandths on a 1.5 inch radius jaw member, to provide some clearance between the jaws when closed for better wedging effect and clamping effect.

Referring now more particularly to FIGS. 3 and 7, the opposite jaw member 28 includes a pivot eye portion 84 having a bore 86 extending therethrough and of the same diameter and on the same center line as the bore **66-66*a* in the jaw member 26. These members 26 and 28 pivot, therefore, about the pin 46 which extends also through the bore 44 and is secured to the base plate 18 by the nut 88 (FIG. 3). The jaw 28 is provided with a projecting or lug portion 30, and a central generally semicircular portion 90. In the same manner but mirror image manner as in the jaw portion 26, the jaw portion 28 is provided with a pilot bore 92 and a radially inwardly extending flange 94 having shoulder portions 96 and 98. There is also provided a counter sink portion 100. The shoulder portion 98 is conveniently chamfered at an angle of approximately 20° to the horizontal, and the shoulder portion 96 is conveniently chamfered at approximately 10° to the horizontal. The counter sink portion 100 is chamfered at 45°. As is the case of the jaw portion 26, while the pilot portion 92 and the flange portion 94 as well as the shoulder portions 96 and 98 and the counter sink 100 may be semicircular in configuration, in practical embodiments, the parting plane of jaws 26 and 28 may be recessed also into the jaw 28 a distance of .001 inches to 0.010 inches. As with the jaw member 26, the lower surface of the jaw member 28 which is in confronting relation with the base plate 18, may be provided with a wedge portion 102 sloping downwardly and outwardly at about 5° to the horizontal as shown in FIG. 7*a*. The projecting lug 30 is conveniently provided with a lip 104** which serves as a retainer for the locking member hereinafter more particularly described.

Figure 5:
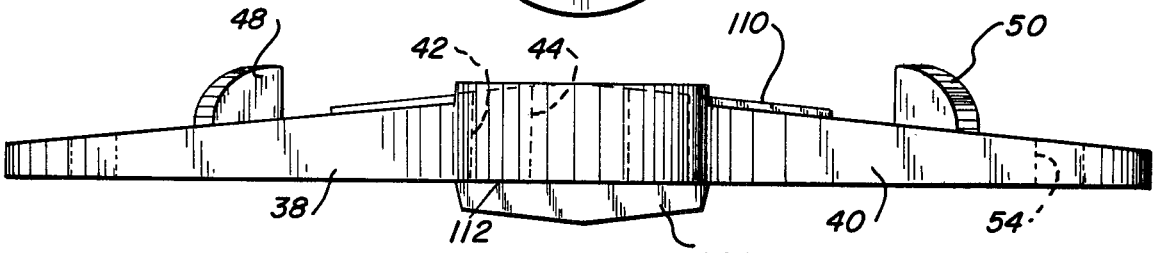
FIG. 5 is a front elevation of the base plate shown in FIG. 4.

FIGS. 4 and 5 show top and side elevations of a generally delta shaped base plate useful in accordance with the present invention, and show in more detail the structure illustrated in FIG. 2. In order to aid in locating the base plate with respect to the wales, there are provided two small spreader bars or struts 106 and 108 spaced apart a shown in FIG. 4 and centrally located on the lower surface of the base plate 18 which is in confronting relation with the wales. This strutting is important so that when the heavy tie is passed through the lock and between the channels, and out through the form, the channels cannot pinch together and thus prevent pass through action. The front side of the base plate is provided at the center with a bilaterally (from the vertical center line as shown in FIG. 4) extending downwardly and outwardly sloping area 110. In the preferred embodiments of the present invention, this taper is valuable in facilitating the opening of the lock. Each of the jaw members 26 and 28 will open in the form of a V and move back and off of the sloped area 110 to either side to permit immediate freeing from the concrete load which the tie and lock has been carrying and from the form tie. The bottom portion 112 of the base plate 18 as shown in FIG. 4 is provided with a bore 44 through which the pin 46 passes and becomes a pivot axis for the jaws 26 and 28. In a preferred embodiment of the present invention the base plate is of substantial weight and design to hold in excess of 35,000 pounds of concentrated load of wet concrete within the form. This provides a substantial safety factor in a system which is designed to be worked on a load of from 24,000 to 25,000 pounds and when the tie rods are spaced on not more than 5′× 5′ spacing. As previously indicated, on each side of the base plate there are provided bumper points 48 and 50 integrally cast with the base plate and for the purpose of preventing the jaws 26 and 28 from opening more than about 30° on either side. This extent of opening will maintain the locking mechanism in a working position to immediately move forward into place and grasp the heavy tie rod end in the proper location when the tie is inserted. The bilateral slope of the central portion 110 is less than 10° and desirably about 5°.

Figure 8:
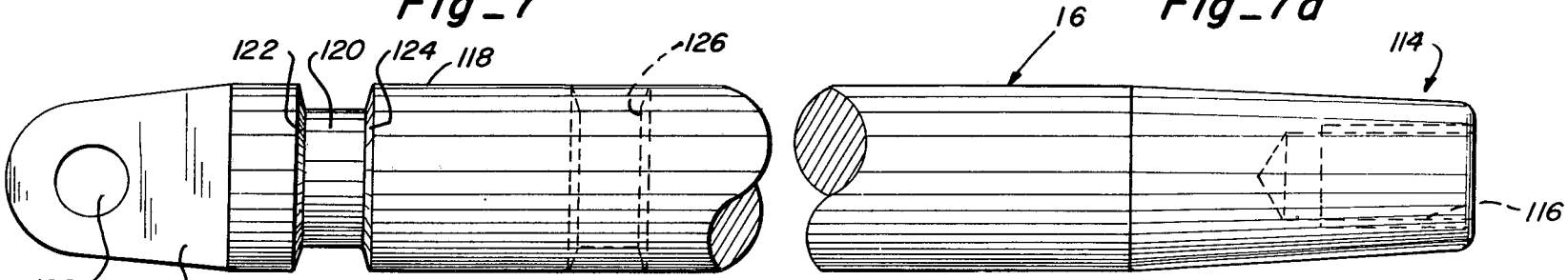
FIG. 8 is a plan view of a tie rod end in a form useful with the clamping locks of the present invention.

FIG. 8 is a plan view of a typical tie rod end modified for use in accordance with the present invention. Except for the modification of the distal extremity (the end of the tie rod which extends beyond the wales) these tie rod ends are of conventional design and known use. As shown in FIG. 8, the proximal extremity 114 of the tie rod end 16 is desirably tapered slightly, for example 3° 3′ over about 2.5 inches in length, and is drilled and threaded as at 116 to accept the threads of a conventional tie rod normally formed of steel and frequently adapted to remain in the concrete. The tie rod end as the structure in FIG. 8 is called, threadedly engages a steel tie rod, for example, at 116 extends beyond the face of the concrete to be cast, through the sheathing and the studs, and through the rails. The distal extremity in the conventional tie rod end is usually threaded to receive a bolt and washer, and, as indicated above, no means are therefore provided to prevent the form portion from moving to the right relative to the tie rod end as shown in FIG. 8 toward the other form wall.

As modified in the present invention, the distal end 118 of the tie rod end 16 is conveniently provided with at least one circumferential recess 120 which is designed and configured for mating coaction with the shoulder portions 74, 76, 96 and 98 of the jaws 26 and 28, respectively when closed. The radially extending side walls of the recess 120 may be perpendicular to the axis of the tie rod end, or tapered as shown in FIG. 8. The taper of the side wall or abutment 122 corresponds and mates with the sloped shoulder portion 74 of the jaw member 26 and the shoulder portion 98 of the jaw member 28 when jaws 26 and 28 are closed about the distal end 118 of the tie rod end of FIG. 8. In like manner the shoulder or abutment portion 124 is desirably correspondingly tapered to coact with the shoulder 26 of the jaw 26 and shoulder 96 of the jaw 28. The wedging effect occasioned by the juncture of the shoulders 74 and 76 and 98 and 96 with the abutments 122 and 124, for example, provides a wedging effect for tight locking retention of the tie rod end. The distal extremity 118 may also be provided with a second recess 126 shown in dotted lines in FIG. 8. In such event the jaw members 26 and 28 would be correspondingly configured to provide a pair of annular flanges formed from the flanges 72 and 94, for example, and their similarly configured flanges when the jaws 26 and 28 are closed. Any number of recesses and flanges may be provided, although for most purposes one or two such recesses and locking flanges will be found satisfactory.

Figure 13:
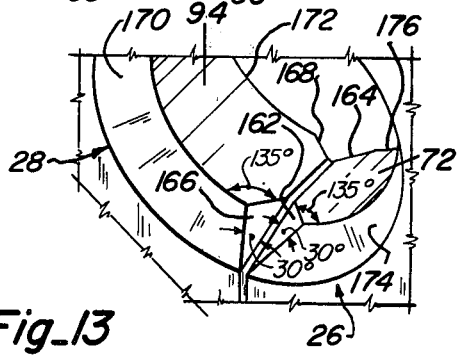
FIG. 13 is a fragmentary perspective view of the jaws in the closed position showing the opposing corners of the locking flanges or teeth chamfered.

FIG. 13 shows an improvement on the structure shown in FIGS. 1, 2 and 3. It has been found desirable to rake back the four corners of the inwardly projecting flange portions 72 and 94, respectively. Thus, the front and back corners 162 and 164 of jaw member 26 and the opposing front and back corners 166 and 168 are filed off or otherwise removed, or chamfered, on the bottom edge of the jaws 26 and 28 that enter the recess 120 on the tie rod end (FIG. 8) first on closing the jaws, and leave the recess 120 last on opening the jaws. Cutting off the corners aids in closing the jaws around the tie rod end, and lets the final stress off the lock better when it is opened. Thus, the best mode of carrying out my invention is the lock structure as shown in FIGS. 1, 2 and 3 as modified by FIG. 13. The breaking of the corners as at 162, 164, 166 and 168 is at 135° to front and back faces 170 and 172, respectively, and 30° to the vertical on jaw 28. In like, but opposite, manner corners 162 and 164 of jaw 26 are broken at 135° to the front and back faces 174 and 176, respectively, and 30° to the vertical.

In a preferred embodiment, the flange formed from the flange portions 94 and 72 of the jaw members 28 and 26, respectively, desirably has a width of about 1/16 of an inch less than the width of the recess 120 in the distal end 118 of the tie rod end of FIG. 8. Such a clearance will allow only 1/16 of an inch of movement of the form when the tie is securely held in place, but will make for easy release and pickup notwithstanding any direct or grit that might otherwise be trapped inside the tooth or gripping area.

For most purposes for a 1 ⅜ inch diameter tie rod end the width of the recess is approximately ½ inch and the corresponding flange approximately 7/16 of an inch. As previously indicated, as many grooves as desired may be provided at the distal end 118. This allows flexibility on each tie end and takes care of wales that may be anywhere from 4 to 8 inch in width.

The extreme left end of the tie rod end shown in FIG. 8 is suitably configured for ease in removal and reclaiming of the tie rod end after the casting has hardened. As shown in FIG. 8, an eye 128 carried in a terminal projection 130 which is integral with the tie rod end may be provided to permit the insertion of a pin and the counterclockwise rotation of the tie end to separate it from the threaded end of the tie rod remaining in the concrete cast structure. The eye 128 also provides a means for attaching a tool to assist in pulling the tie rod end out of the forming structure after the base plate and locking assembly has been removed therefrom. Any other configuration for the end exposed beyond the clamping lock of the present invention may be employed, and many such forms are available in the field at the present time. These include ends shaped for use with an impact wrench or a cresent wrench, and the like.

In FIG. 9 one mode of locking the jaws 26 and 28 together is illustrated. There is here shown in exploded relation a lever handle 132 and a U-shaped strap 134 which is dimensioned and configured for throwing over the lug 30 of the jaw member 28 and for retention behind the lip 104. As shown in FIG. 9, a fragment of the projecting portion 36 of the jaw 26 is provided with a bore 60 to accept a rivet 136 which extends through the arms 138 and 140 at pivot holes 142 and 144. The spacing between the arms 138 and 140 is such as to accommodate therebetween the width of the projecting portion 36 of the jaw 26. After insertion of the rivet through the pivot holes 142 and 144 and the bore 60, the rivet 136 is set in a known manner.

The U-shaped strap 134 is pivotally mounted on the lever 132 intermediate the extremities thereof and preferably closely adjacent the axis of rotation of the lever 132 about the rivet 136. Attachment of the U-shaped strap 134 is conveniently achieved by means of a pivot pin 146 extending through a washer 148, the pivot hole 150 in the distal end of one leg of the U-shaped strap 134, the pivot hole 152 in the arm 138, the pivot hole 154 in the arm 140, the pivot hole 156 in the distal end of the opposite arm of the U-shaped strap 134, the washer 158, secured in position by means of nut 160.

In use, then, the strap 134 is thrown over the lug 30 of the jaw member 28 and the lever handle 132 rotated about the rivet 136 "past center" thereby effecting a locking of the jaws 26 and 28 together in a manner which cannot be thwarted by the weight of wet concrete poured into a form.

Figure 12:
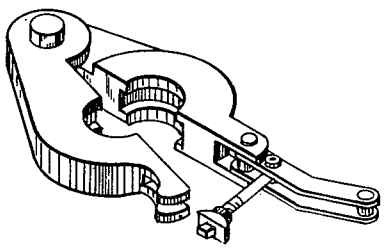
FIGS. 10, 11 and 12 are illustrations of other locking devices for holding the jaws in closed position, and showing only the jaws and closing locks therefor.
Figure 11:
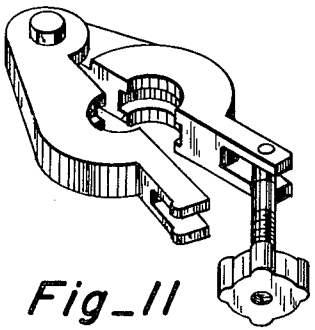
Figure 10:
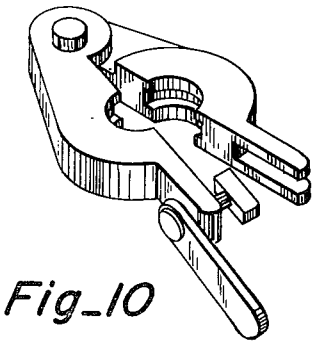

With the throw over lever type structures, such as shown in FIG. 9, the handle portions 132, for example, may be coated with a bright colored paint. It is quite easy then to determine by the position of the handle whether all of the clamping locks have been properly closed before the pour is started. Examples of some other forms of locks are illustrated in FIGS. 10, 11 and 12, and in view of the preceding discussion are believed fully self-explanatory. FIGS. 10, 11 and 12 omit the base and illustrate merely various locking means for holding the jaws closed.

Figure 14:
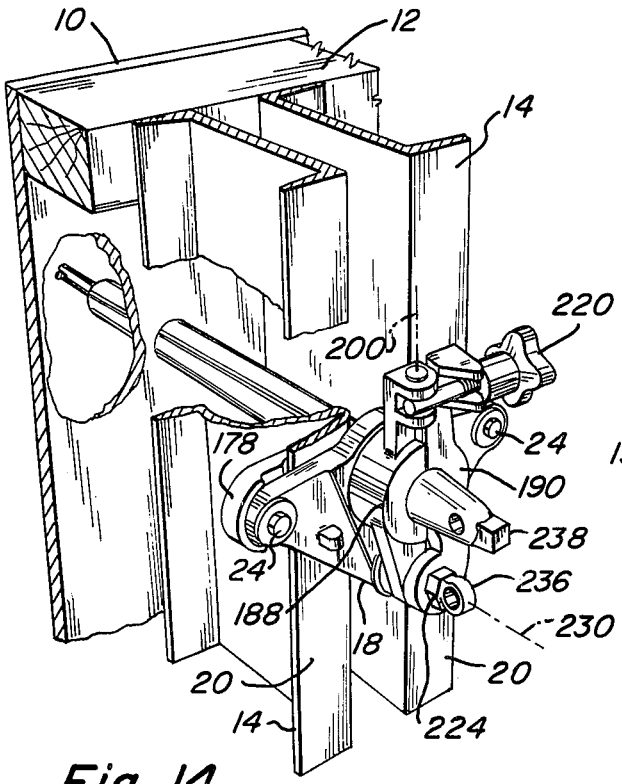
FIG. 14 is a perspective view showing a portion of a concrete casting form and a still further modified embodiment of the clamping lock of the present invention.

In FIG. 14 another embodiment of applicant's clamping lock is illustrated in conjunction with a portion of a concrete casting composition form structure, the components of which are essentially the same and bear the same reference numerals used in FIG. 1. Base plate 18 is clamped to flange 20 of channel beams 14 by holddown plates 178 which are secured to plate 18 by bolts 24 which extend through plate 18 and force holddown plates 178 tightly against the inner surfaces of flanges 20 by being screwed into bores 180 as is best illustrated in FIGS. 23 and 17.

Figure 17:
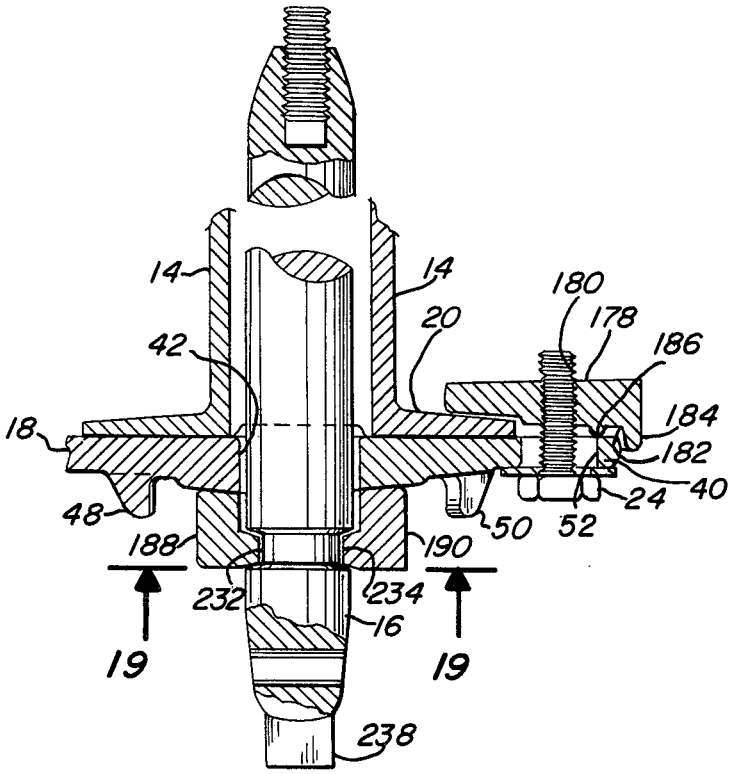
FIG. 17 is a section taken on line 17—17 of FIG. 15.
Figure 23:
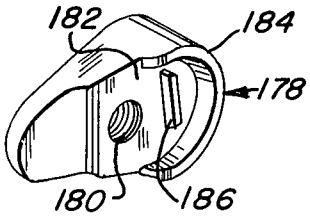
FIG. 23 is a perspective view of the holddown plate of the clamping lock illustrated in FIG. 15.

Holddown plate 178 as illustrated in FIGS. 17 and 23 has a threaded bore 180 substantially in its center. The upper substantially planar surface 182 of plate 178 has a curved rim, or ridge, 184 around part of the periphery of surface 182. Ridge 184 is shaped to fit loosely around that portion of right wing portion 40 of base plate 18 surrounding bore 52, for example, to position bore 180 substantially in line with bore 52 so that bolt 24 can be readily threaded into bore 180. In addition ridge 184 prevents turning of holddown plate 178 relative to base plate 18.

Holddown plate 178 is also provided with a substantially straight rib 186 which engages the inner surface of base plate 18 that contacts the flanges 20 of wales 14. The bending moments created when rib 186 contacts plate 18 permits holddown plate 178 to securely attach base plate 18 to flanges 20 of wale 14, particularly when flanges 20 are made of relatively thin steel.

Figure 22:
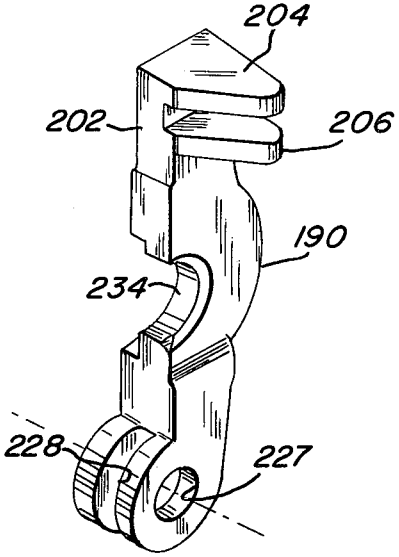
FIG. 22 is a perspective view of the second jaw of the embodiment of the clamping lock illustrated in FIG. 15.
Figure 21:
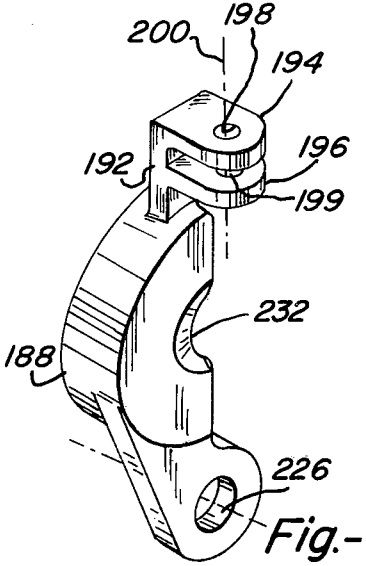
FIG. 21 is a perspective of one of the jaws of the embodiment of the clamping lock illustrated in FIG. 15.

Referring to FIGS. 21 and 22, jaws 188, 190 are substantially similar in construction to jaws 28, 26 of FIG. 3, for example, except with respect to the means for bringing jaws 188 and 190 together and then releasably holding or locking them together. Jaw 188 is provided with a lug 192 on one side of which there are formed a pair of spaced pivot projections or pivot eyes 194, 196 having pivot bores 198, 199 formed through them. The center of bores 198, 199 define a pivot axis 200. Jaw 190 is provided with a lug 202 which has a pair of spaced apart locking projections 204, 206 formed on one side of lug 202.

Figure 16:
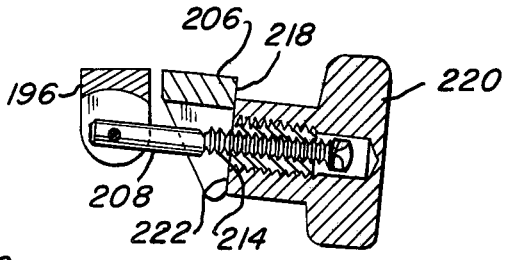
FIG. 16 is a section taken on line 16—16 of FIG. 15.
Figure 15:
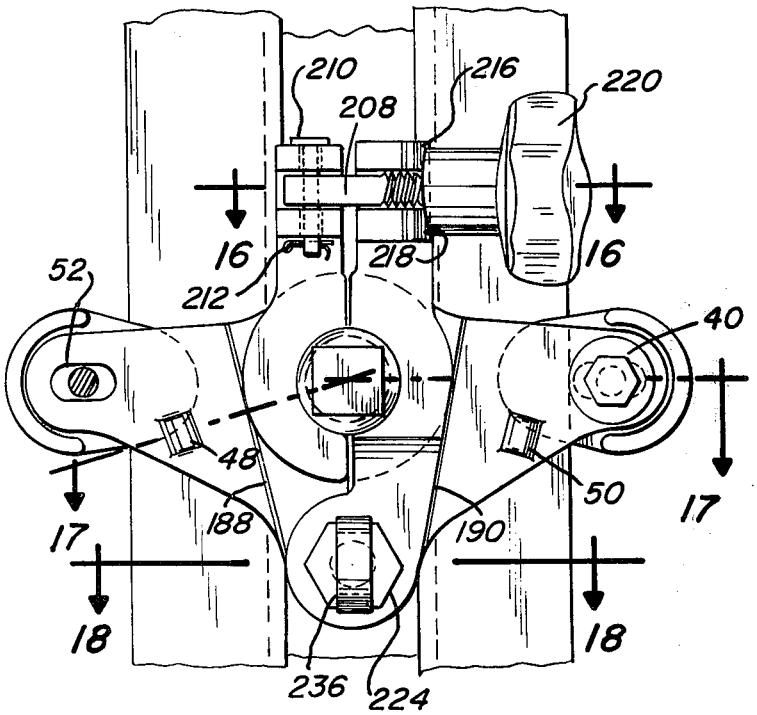
FIG. 15 is a front elevation at an enlarged scale of the clamping lock illustrated in FIG. 14.

Swing bolt 208 is pivotally mmounted by clevis pin 210 which fits within pivot bores 198, 199 of pivot projections 194, 196 and is removably held in place by cotter pin 212. Pivot projections 194, 196 and locking projections 204, 206 are positioned on lugs 192, 202 of jaws 188, 190 so that when the jaws are substantially closed as illustrated in FIGS. 14 and 15, swing bolt 208 fits within locking projections 204, 206 and the threaded portion 214 of swing bolt 208 projects substantially beyond the locking surfaces 216, 218 of projections 204, 206. Handle 220 which is internally threaded, is threaded onto swing bolt 208. Locking surface 222 of handle 220 which contacts the locking surfaces 216, 218 of projections 204, 206 is substantially normal to the longitudinal axis of bolt 208 as is illustrated in FIGS. 15 and 16. Locking surfaces 214, 216 have a slight slope toward pivot axis 200 to facilitate inserting and removing swing bolt 208 between projections 204, 206 without having to loosen handle 220 to the same extent as would otherwise be the case if locking surfaces 214, 216 did not have such a slope.

Figure 20:
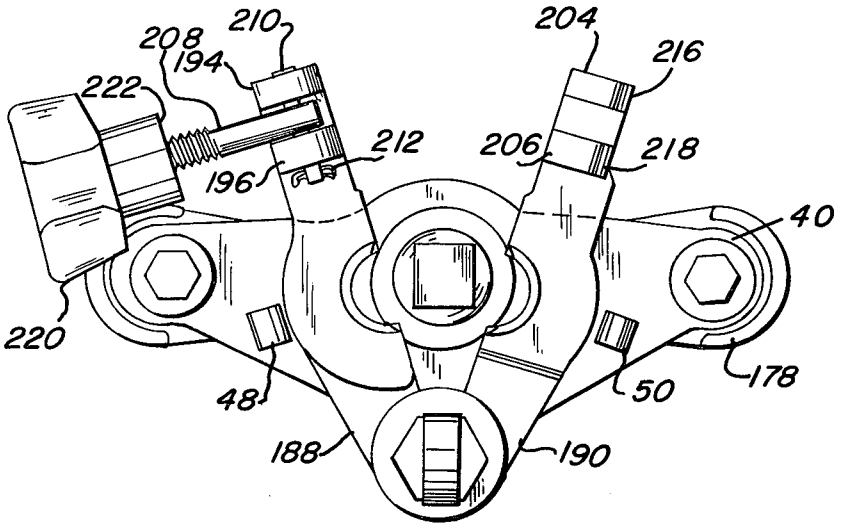
FIG. 20 is a view similar to FIG. 15 except that the jaws of the clamping lock are open.

In use the jaws 188, 190 are secured to base plate 18 by pin 224 which fits through bores 226 of jaw 188 and bores 227, 228 of jaw 190. Pin 224 is threaded into nut 88 so that jaws 188, 190 pivot about longitudinal axis 230 of pin 224 and substantially lie in a plane which is normal to axis 230. Jaws 188, 190 are restricted in their movement by stops 48, 50 as seen in FIG. 20. Base plate 18 is then secured to the wales 14 through the action of holddown plates 178 and bolts 24 which are threaded into the threaded bores 180 of plates 178. The distal portion of the tie rod end 16 can be inserted through the bore 42 in base plate 18 and between jaws 188, 190. If tie rod 16 is in place before plate 18 is secured to wales 14, plate 18 can be fitted around tie rod 16 prior to its being fastened to wales 14.

Figure 19:
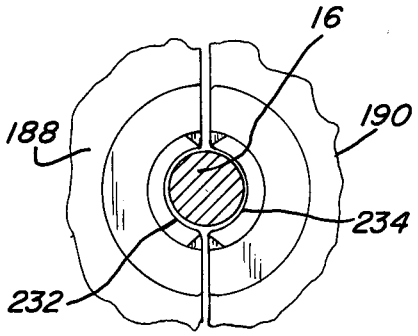
FIG. 19 is a section taken on line 19—19 of FIG. 17.

The jaws 188, 190 are then moved together until swing bolt 208 can fit between the locking projections 204, 206 of jaw 190. Handle 220 is then turned to force jaws 188, 190 together so that the flanges 232 of jaw 188 and flange 234 of jaw 190 fit into a recess such as recess 120 in tie rod end 16, as is best illustrated in FIGS. 17 and 19. This removably locks the tie rod end 16 to the wales 14.

With respect to the embodiment of the releasable locking means illustrated in FIGS. 14, 15 and 16 compared with the embodiment illustrated in FIGS. 9, 10, 11 and 12, it should be noted that the pivot axis 200 of swing bolt 208 lies in a plane substantially perpendicular to the longitudinal axis 230 of pin 224 which is also the pivot axis of jaws 188, 190. As a result when base plate 18, which is normally mounted so that it is substantially in a vertical plane, there is no gravitational component acting on the releasable locking means that tends to cause handle 220 and swing bolt 208 to move to a position out of contact with the locking projections 204, 206 if base plate 18 is mounted so that it is 90°, 180° or 270° from the position illustrated in FIG. 14. Obviously once handle 220 is tightened to close jaws 188, 190 swing bolt 208 is no longer free to move about its pivot axis 200.

Figure 18:
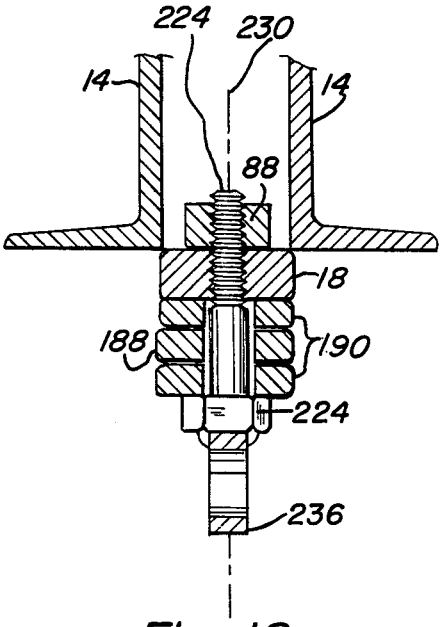
FIG. 18 is a section taken on line 18—18 of FIG. 15.

In the embodiment illustrated in FIG. 14, 15 and 18 the head of pin 224 has a ring 236 fixedly attached thereto by welding, for example, and the distal end of tie rod 16 is provided with a square head 238. Ring 236 provides an additional means for applying torque to pin 224 and for forcibly removing it. Square head 238 provides means for applying torque to the tie rod end 16 by a wrench to either secure it to a tie rod or to release it.

From the foregoing it should be evident that various modifications can be made to the described embodiments without departing from the scope of the present invention.

What is claimed is:

1. A clamping lock for use with a tie rod end in a settable casting combination from structure, said clamping lock comprisng:

a base plate having a tie rod end receiving bore extending therethrough and a jaw confronting surface;

means on said base plate for fastening said base plate to said casting form structure;

a pair of jaws pivotally anchored on said base plate and selectively movable about a first pivot axis between an open position and a closed position about the tie rod end, said jaw confronting surface of the base plate uniformly decreasing in thickness bilaterally from a line corresponding to the parting line of the jaws when closed to exert a wedging effect on the jaws in closing and a quick release effect in opening, each of said jaws having a pair of spaced projections;

means on said jaws for coacting between the jaws when closed and a tie rod end for preventing axial movement of the jaws with respect to the tie rod end;

a threaded swing bolt pivotally mounted between the pair of projections on one jaw and arranged to pivot about a second pivot axis; and a handle threaded on the threaded portion of the swing bolt, said swing bolt being pivotable about said second pivot axis so that it can fit between the projections on the other jaw and the handle can engage and be tightened against said projections on the other jaw to lock said jaws in their closed position.

2. A clamping lock in accordance with claim 1 wherein:

the second pivot axis lies in a plane substantially parallel to a plane in which the jaws move.

3. A clamping lock in accordance with claim 1 wherein:

the second pivot axis lies in a plane perpendicular to the first pivot axis.

4. A clamping lock for use with a tie rod end in a settable casting combination form structure, said clamping lock comprising:

a base plate having a tie rod end receiving bore extending therethrough and a jaw confronting surface;

one or more bolts extending through the base plate;

one or more holddown plates each having a thraded bore and a rim, said bolts being received in the threaded bores and the rims being engagable with a portion of the periphery of the base plate whereby said base plate is adapted to be detachably mounted to said form structure;

a pair of jaws pivotally anchored on said base plate and selectively movable about a first pivot axis between an open and a closed position about the tie rod end, said jaw confronting surface of the base plate uniformly decreasing in thickness bilaterally from a line corresponding to the parting line of the jaws when closed to exert a wedging effect on the jaws in closing and a quick release effect in opening;

means on said jaws for coacting between the jaws when closed and a tie rod end for preventing axial movement of the jaws with respect to the tie rod end; and means on said jaws for releasably locking said jaws in the closed position.

5. A clamping lock in accordance with claim 4 wherein:

each holddown plate is provided with a rib for engaging the base plate.

6. In a concrete forming system including sheathing, studs, wale members and tie rods, the improvement which comprises in combination:

a tie rod end having one end internally threaded for threaded engagement with a tie rod, and an outer end extending beyond said wale members, said outer rod end having at least one circumferential groove;

a tie rod end clamping lock attached to at least one of said wale members comprising in combination:

a base plate having a tie rod end receiving bore extending therethrough and a jaw confronting surface;

means on the base plate for fastening said base plate to a wale member;

a pair of jaws pivotally anchored on said base plate and selectively movable with respect to a pivot axis between an open position and a closed position about the outer end of said tie rod end, said jaws forming an annulus when closed and having a surface cooperating with said jaw confronting surface to exert a wedging effect on the jaws in closing and a quick release effect in opening;

the annulus of said jaws when the jaws are in the closed position being arranged to engage at least one circumferential groove on said tie rod end so that the tie rod end is restricted in movement with respect to the jaws;

a first lug formed on one of said jaws having a pair of spaced apart pivot projections formed thereon, each of said pivot projections having a pivot bore;

a swing bolt having a threaded portion mounted on said pivot projections to pivot around a second pivot axis through the pivot bores;

a second lug formed on the other of said two jaws having a pair of spaced apart locking projections having locking surfaces formed thereon, said locking projections being positioned relative to said pivot projections so that the swing bolt can fit between said locking projections; and a handle having a locking surface threadably mounted on said swing bolt, the locking surface of said handle being engagable with the locking surfaces of said locking projections to lock said jaws in their closed position.

7. In the combination of claim 6 wherein:

the second pivot axis lies in a plane substantially parallel to a plane in which the jaws move.

8. In the combination of claim 6 wherein:

the second pivot axis lies in a plane perpendicular to the first pivot axis.

9. In a concrete forming system including sheathing, studs, wales and tie rods, the improvements which comprises in combination:

a tie rod end having one end internally threaded for threaded engagement with a tie rod, and an outer and extending beyond said wales, said outer end having at least one circumferential groove;

a tie rod end clamping lock comprising in combination:

a base plate having a tie rod end receiving bore extending therethrough and a jaw confronting surface;

one or more bolts extending through the base plate;

one or more holddown plates each having a rim and a threaded bore into which the bolt is threaded, said rim being engageable with a portion of the periphery of the base plate for positioning the holddown plate relative to the base plate and for resisting relative rotation of the holddown plate relative to the base plate, said bolt and holddown plate removably mounting said base plate to said wales;

a pair of jaws pivotally anchored on said base plate and selectively movable with respect to a pivot axis between an open position and a closed position about the outer end of said tie rod end, said jaws forming an annulus when closed and having a surface cooperating with said jaw confronting surface to exert a wedging effect on the jaws in closing and a quick release effect in opening;

the annulus of said jaws when the jaws are in the closed position being arranged to engage at least one circumferential groove on said tie rod end so that the tie rod end is restricted in movement with respect to the jaws; and means on said jaws for releasably locking said jaws in the closed position about the outer end of said tie rod end.

10. In the combination of claim 9 wherein:

each holddown plate is provided with a rib for engaging the base plate for clamping wales made of thin material.

* * * * *